US009826811B1

(12) United States Patent
Greenlaw

(10) Patent No.: US 9,826,811 B1
(45) Date of Patent: Nov. 28, 2017

(54) SMOOTHING SOFT ROLLER

(71) Applicant: Zara R Greenlaw, Oxnard, CA (US)

(72) Inventor: Zara R Greenlaw, Oxnard, CA (US)

( * ) Notice: Subject to any disclaimer, the term of this patent is extended or adjusted under 35 U.S.C. 154(b) by 159 days.

(21) Appl. No.: 14/731,858

(22) Filed: Jun. 5, 2015

Related U.S. Application Data

(60) Provisional application No. 62/008,287, filed on Jun. 5, 2014.

(51) Int. Cl.
*A45D 2/20* (2006.01)
*A45D 2/12* (2006.01)
*A45D 6/18* (2006.01)

(52) U.S. Cl.
CPC ..... *A45D 2/125* (2013.01); *A45D 6/18* (2013.01)

(58) Field of Classification Search
CPC ..... A45D 2/127; A45D 2/18; A45D 2/2442; A45D 2/2435; A45D 2/2492; A45D 19/008; A45D 19/0025; A45D 8/40; A45D 7/065
See application file for complete search history.

(56) References Cited

U.S. PATENT DOCUMENTS 1,473,749 A * 11/1923 Vandamark ..... A45D 2/148 132/250
2,129,246 A * 9/1938 Sterling ..... A45D 7/065 132/220
2,481,448 A * 9/1949 Schiller ..... A45D 2/18 132/248
2,524,266 A 10/1950 Licastro
2,563,421 A 8/1951 Roth
2,776,666 A 1/1957 Papandrea
4,310,008 A * 1/1982 Lalli ..... A45D 2/14 132/247
5,025,816 A 6/1991 Jones
5,372,152 A * 12/1994 Dutch ..... A45D 2/18 132/246
5,411,040 A 5/1995 Forrest
5,694,955 A 12/1997 Grooms
5,771,907 A 6/1998 Dickson
2009/0151742 A1* 6/2009 Malitzis ..... A45D 8/36 132/273

FOREIGN PATENT DOCUMENTS

JP 10215940 * 8/1998

* cited by examiner

*Primary Examiner* — Todd E Manahan
*Assistant Examiner* — Brianne Kalach

(57) ABSTRACT

A soft roller system that provides for a moisture retaining outer casing that keeps hair from drying out, a firm, yet flexible honeycomb type core that allows the foam roller to keep its shape under compression that is caused by the pressure of the head during sleep, and a moisture retaining band to secure the ends of a tress of hair between the soft fabric casing and smoothing band to secure the ends of the hair and protect the hair from breakage and ware.

6 Claims, 4 Drawing Sheets

"Prior Art"

SMOOTHING SOFT ROLLER

REFERENCE TO PRIOR APPLICATION

This application claims priority of the provisional patent application 62/008,287, filed Jun. 5, 2014 entitled SOFT ROLLER by Zara Greenlaw.

BACKGROUND OF THE INVENTION

Field of the Invention

The field of this invention relates generally to the field of hair curlers and more specifically toward an improved soft roller that has a firm but flexible center that stabilizes the foam roller to prevent over compression and kinking of the hair and support a continuous more natural curl pattern, an outer casing with securing wraps and a smoothing band all of which are constructed of non-absorbing fabric that retains oils and moisture in the hair and secures the ends of a tress of hair to protect the hair from tangles, dryness and breaks.

Description of the Prior Art

Human hair has for a long time been molded through a variety of means to provide a variety of intentional shapes and styles to the hair. It has been common practice to use rollers to curl wet or dry tresses of hair, or to maintain hair in a previously set and desired shape while resting and overnight. Heating and steaming tools on wet or dry hair in conjunction with rollers can also aid in this attempt to curl hair or preserve a curl pattern. The use of heat or steam is not always desirable, because when used on a regular basis, the tools used and heat can cause damage to hair.

As an alternative to heat for curling or styling, hair has been wrapped in rollers that do not use heat or steam. One problem with prior art styles of this type of roller is that the rollers, when stiff, are painful to sleep on. This problem has been dealt with in the past through the use of soft foam or fabric covered soft curlers that provide a cushion when pressure is applied while sleeping. The problem with this method is that the foam compress while sleeping, which can leave kinks and irregular shapes in the hair that are not desired. Also, a soft roller when compressed can allow hair ends to shift around and become tangled or exposed to outside elements (pillow, fabric, and etc.), that can damage hair or absorb oils and moisture out of the hair. This unwanted exposure can cause the hair to become worn and brittle and break. Furthermore, contemporary foam rollers when compressed can allow hair ends to lodge and become trapped inside the hollow areas of the foam or to catch on the securing mechanisms of the roller producing painful brakes, snags and tangles. Often the materials used to cover foam rollers sponge away moisture and can leave hair overly dry and brittle. The hair ends are especially susceptible to dryness and easy breakage either with or without the application of heat just by virtue of the fact that they are the oldest part of the hair and take the most abuse over time.

It is the object of the instant invention to provide an improved roller that forms and maintains curled hair and overcomes the limitations of the prior art in that it provides a foam curler with a firm but flexible core that stabilizes the foam so that it is not so soft that the hair becomes misshaped from compression. Furthermore, the instant invention uses covering fabric that retains the oils and moisture in the hair, thereby increasing moisture retention in the hair and this reduces the need and the frequency to reapply conditioners and moisturizers thereby the user can save money. The instant invention has a smoothing band; a means to hold ends of the hair isolated and secure and by this means protected from exposure, damage and movement in an undesired direction. The roller of the instant invention is designed to create a more desirable curl, protect and preserve the shape of curled hair by preventing unwanted kinks and crimps, retaining hair moisture, securing and protecting the ends of a tress of hair from damage and exposure that can cause dry and tattered follicles, and does not involve the application of heat and stress that can damage hair.

SUMMARY OF THE INVENTION

The basic embodiment of the present invention teaches a soft roller comprising: a supporting center grid that is substantially cylindrical and having a porous and firm but flexible structure through a plurality of vertical and horizontal supports resulting in a plurality of apertures therebetween; a foam layer surrounding said supporting center grid; a soft fabric casing, with extending wings/flaps, surrounding said foam layer; a soft fabric smoothing band, with gathering material stitched through, attached to said soft fabric casing, said retaining band providing a space for the securing therein of the ends of hair to be rolled around said soft roller; a first wing/flap which is an extension of the soft fabric casing surrounding said foam layer; and a second wing/flap which is an extension of the soft fabric casing surrounding said foam layer wherein said first wing/flap and said second wing/flap are attachable to each other.

The above embodiment can be further modified by defining that said soft fabric casing and band are made of a hydrophobic material, such as satin.

A second embodiment of the instant invention teaches a method for rolling hair that protects the ends of said hair comprising the steps of: isolating a tress of hair to be shaped; acquiring a soft roller around which to roll said tress of hair, said soft roller further comprising: a supporting center grid that is substantially cylindrical and having a porous and firm but flexible structure through a plurality of vertical and horizontal supports resulting in a plurality of apertures therebetween; a foam layer surrounding said supporting center grid; a soft fabric casing, with extending wings/flaps, surrounding said foam layer; a soft fabric smoothing band, with gathering material stitched through, attached to said soft fabric casing, said retaining band providing a space for the securing therein of the ends of hair to be rolled around said soft roller; a first wing/flap which is an extension of the soft fabric casing surrounding said foam layer; and a second wing/flap which is an extension of the soft fabric casing surrounding said foam layer wherein said first wing/flap and said second wing/flap are attachable to each other; pulling said tress of hair down through space between said soft roller and said retaining band; sliding said soft roller down said tress of hair to smooth and secure ends of said tress of hair between said retaining band and said soft fabric case; wrapping remaining said tress of hair around soft roller and smoothing band and hair ends that are flanked by band and casing; moving said first wing/flap over said soft roller to come in contact with said second wing/flap without twisting said first wing/flap or said second wing/flap; attaching said first wing/flap to said second wing/flap; letting said tress of hair dry or rest and form; and detaching said first wing/flap from said second wing/flap, releasing said tress of hair from said soft roller.

The above embodiment can be further modified by defining that said soft fabric casing and band are made of a hydrophobic material.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
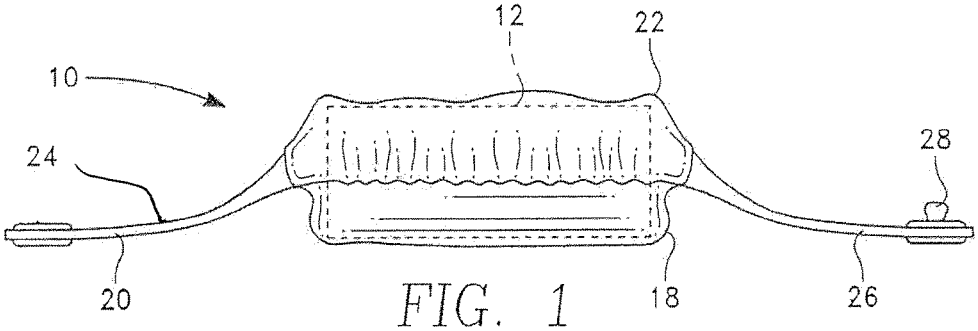
FIG. 1 is a side view of the soft roller of the instant invention.
Figure 2A:
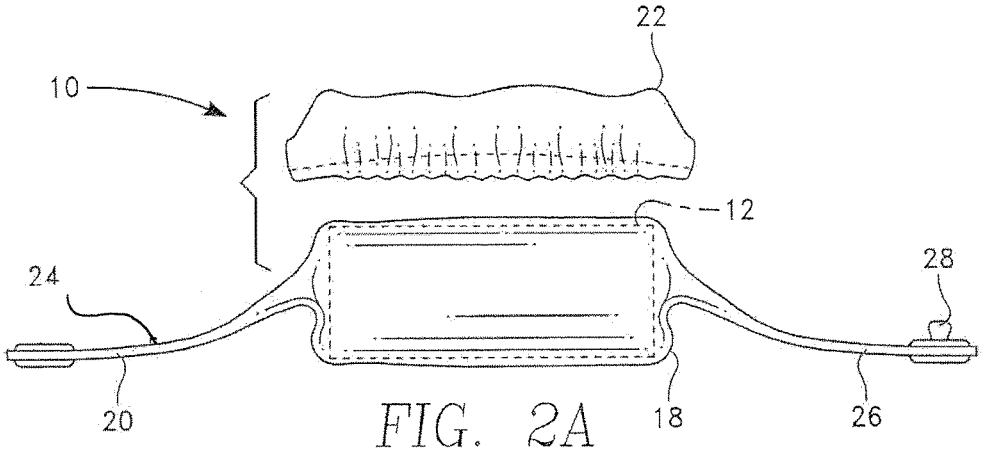
FIG. 2A is the view as shown in FIG. 1 but with the securing pocket separated from the curler.
Figure 2B:
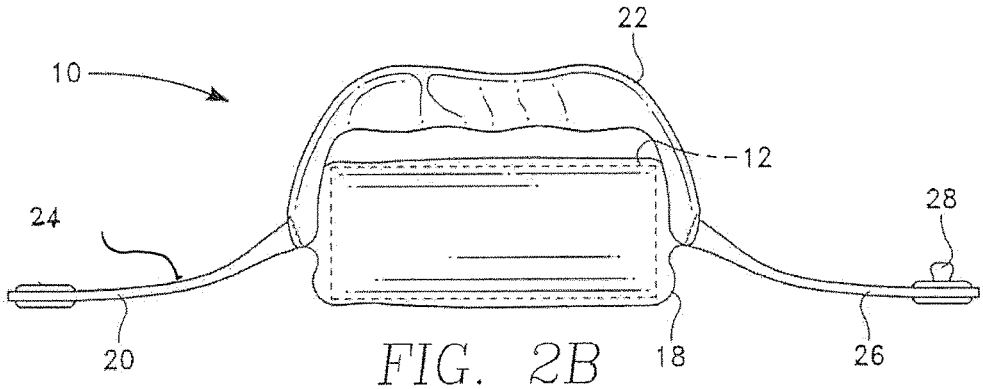
FIG. 2B is the view as shown in FIG. 2A but with the securing pocket attached to the smoothing band illustrating the space between for securing the ends of the hair tress.
Figure 3:
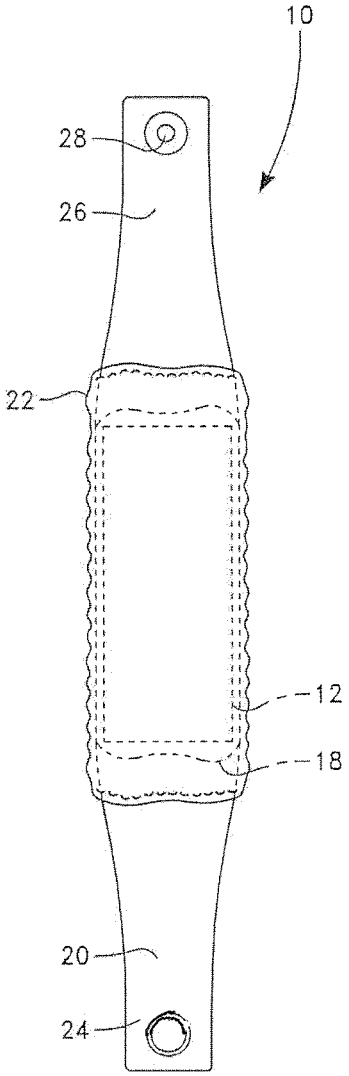
FIG. 3 is a top view of the curler of the instant invention.

Turning to the drawings, the preferred embodiment is illustrated and described by reference characters that denote similar elements throughout the several views of the instant invention.

The preferred embodiment provides for a soft roller 10 that is shaped substantially like a cylinder at its main body. The cylinder 12 is made of foam and has a center portion 14 that is left vacant. The foam portion of the cylinder 12 is approximately 1/4" thick but this dimension can be expanded or reduced as desired.

Figure 7A:
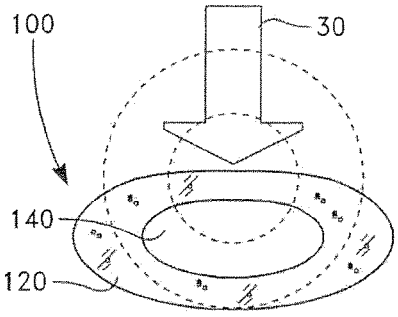
FIG. 7A is a top view of a prior art soft roller under compression.

Inside of the space in the center 14 of the cylinder 12 is placed a plastic firming device/center support grid 16 that is sufficiently pliable to absorb the force of the hair and head while sleeping. This will provide some give but it will not be so pliable that the foam portion collapses with the application of pressure by the user's head during sleep. Furthermore, it will not be so firm as to cause substantial discomfort during sleep. Prior art rollers without this center support grid 16 allow the rollers to be compressed to a larger degree as seen in FIG. 7A. In the prior art curler 100, there is only a foam cylinder 140. When pressure is applied to the prior art device 30 the shape of the cylinder is distorted.

Figure 7B:
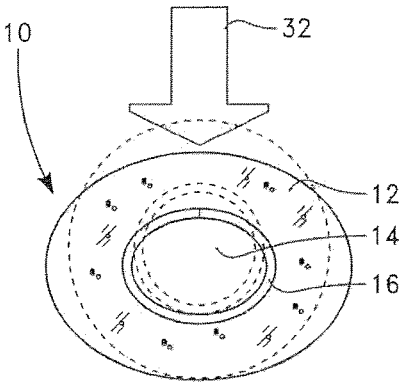
FIG. 7B is a top view of the soft roller of the instant invention under compression.

FIG. 7B shows the instant curler 10 with the foam cylinder 12 fortified with the support grid 16 whereupon the application of pressure 32 does not provide nearly the level of distortion as found in the prior art device 100.

Figure 5:
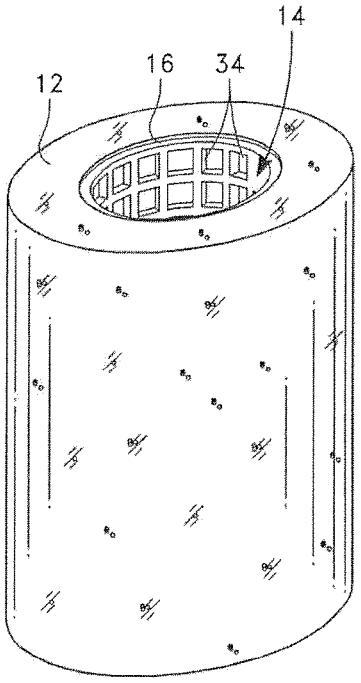
FIG. 5 is a perspective view of the foam cylinder/center support grid portion of the soft roller of the instant invention.
Figure 6:
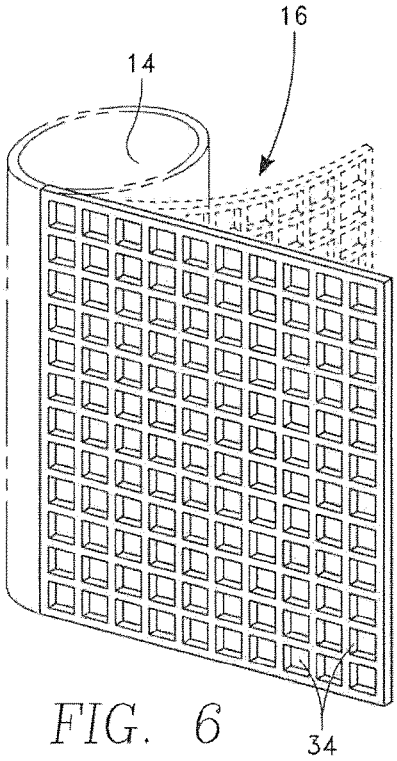
FIG. 6 is a perspective view of the center support grid portion of the instant invention showing its honeycomb type structure with a plurality of apertures.

The plastic firming device/center support grid 16 has a honeycomb structure with a series of apertures 34 to give the firming device 16 structure and flexibility as seen in FIGS. 5-6.

The structure of the entire curler 10 is shown in FIGS. 1-4A. The foam cylinder 12 with center support grid 16 is wrapped in a casing of soft fabric 18 that does not sponge out the hair oils and moisture thereby allowing the moisture to remain in the hair as it dries and forms the desired shape. A smoothing band 20 is attached to the outer cloth 18 in a way that a securing space, thereby creating a pocket 22 into which a tress of hair 36 can be pulled through up or down until the ends of said tress of hair are no longer visible below said smoothing band and are flanked by the cover and the band. This is illustrated in FIG. 4B.

Figure 4A:
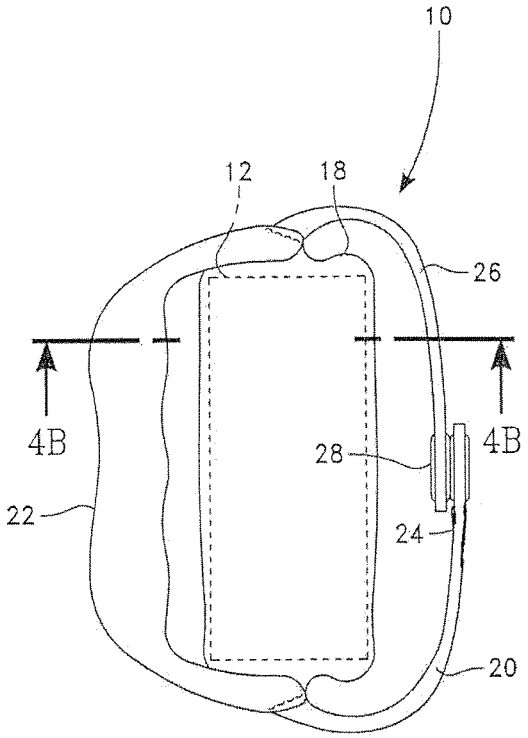
FIG. 4A is a side view of the curler of the instant invention showing the smoothing band and securing pocket wrapping around the foam cylinder and plastic firming center as it would be secured with hair wrapped therearound.
Figure 4B:
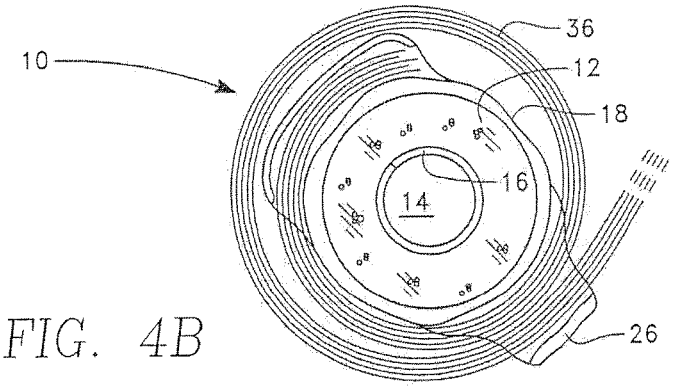
FIG. 4B is taking along the line 4B-4B in FIG. 4A with a tress of hair shown secured therein.
Figure 4C:
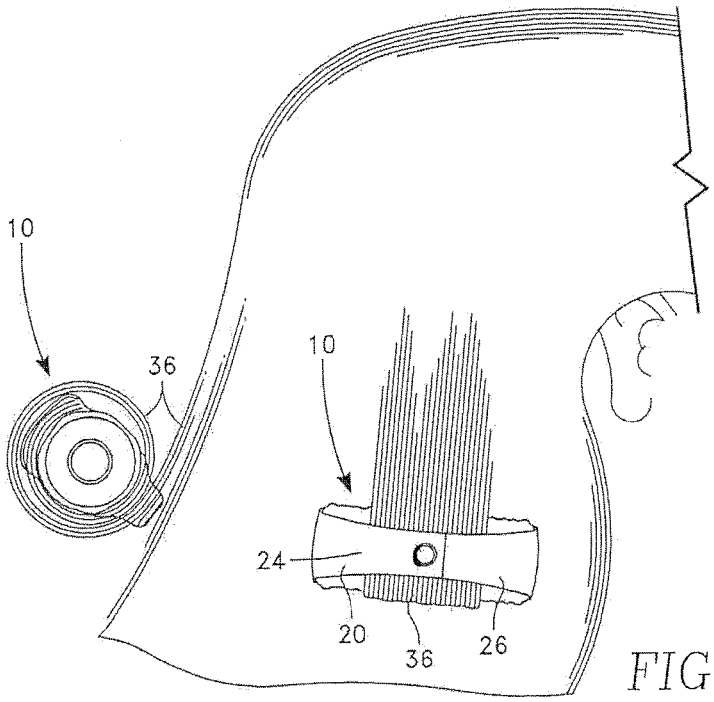
FIG. 4C shows the curler of the instant invention in two positions on the head of a user.

The cylinder 12 is then wrapped around the tress of hair 36 until the portion desired to be shaped has been rolled thereon. The outer casing 18 terminates on either end with a first flap 24 and a second flap 26. The two flaps are attachable to each other through an attachment means 28, such as snaps, hooks and loops and the like. It is important to note that the two flaps 24, 26 must not twist around each other to secure the hair as this will cause more undesired kinking and crimping of the hair. FIG. 4C shows the curler 10 from the side as well as from the top on the head of a user.

The material of the outer cloth 18 and the smoothing band 22 is chosen for its hydrophobic properties so that moisture is retained in the hair. This prevents the hair from quickly drying out and appearing frizzy. The smoothing band 22 protects the ends of the hair and adds an extra level of moisture retention and protection for the hair ends, ensuring that they do not become exposed to moisture absorbing elements or snag on a feature of the roller or twist upon other strands of hair. The ends of the hair are completely covered by the smoothing band 22 and held between the smoothing band and the foam 12, which is covered by the soft cloth casing 18 as the hair is rolled. The ends of the hair are held in place by the smoothing band 22 while the wearer sleeps or as the hair dries thereby preventing the hair ends from flying away or fraying.

In standard foam hair rollers, and especially with already very curly hair, the hair can get sucked into the catacombs of the foam of the roller and the hair won't readily come out therefrom when the curler is removed. This can cause pulling damage and breakage. The soft cloth casing 18 of the instant invention coupled with the smoothing band 22 creates a pouch that serves to protect the hair from snags and breaks that can result from the prior art type of roller. The instant invention also protects the hair ends from the foam and attachments protecting the ends from the outer environment and being broken without the protection of the smoothing band 22.

The firm yet flexible honeycomb-type supporting grid 16 with is series of apertures 34 is encased in the foam 12, which is covered with the soft cloth casing 18. The soft cloth casing resists absorption of moisture, the foam keeps the roller soft and the supporting grid 16 with its honeycomb structure helps maintain the shape of the roller under compression with minimal distortion. See FIG. 7B. This combination of features protects the style and shape of the curl while protecting the hair follicle/shaft. The smoothing band 22 and created pocket protect the ends from breakage and from becoming brittle and worn. Curlers with foam alone can crease the hair. This can create a curl that is not smooth and that can have one or more undesirable kinks and/or bends.

To use the curler 10 of the instant invention, the following steps are followed. First, a section or lock of hair 36 is separated. Second, the section or lock of hair 36 is inserted into the opening between the smoothing band 22 and the foam cylinder 12, which is covered in soft cloth 18. Third, the section of hair 36 is adjusted up so that only the end of the tress of hair 36 is flanked by the smoothing band 22 and the foam portion 12, which is covered in soft cloth 18. Fourth, prior to rolling, the smoothing band 22 is held in such a way as to press the ends of the tress of hair 36 between the smoothing band 22 and the foam portion 12 covered in soft cloth 18. Fifth, while holding the hair ends 36 secure between the smoothing band 22 and the foam 12, which is covered by the soft cloth 18, the curler 10 is rolled up the length of the lock of hair 36 so that the lock of hair 36 laps, or rolls on top of, the smoothing band 22 and the hair ends are captured between the band 22 and the soft foam 12, which is covered by the soft cloth 18. The rolling of the soft curler 10 continues along the lock of hair 36 until the desired amount of hair is wrapped around the roller. Finally, the curler 10 is secured with the winged sections 24, 26, which hold the roller in place and secured with the attachment means 28.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A soft roller comprising:

a supporting center grid that is substantially cylindrical and having a porous and firm but flexible structure through a plurality of vertical and horizontal supports resulting in a plurality of apertures therebetween;

a foam layer surrounding said supporting center grid;

a soft fabric casing surrounding said foam layer;

a soft fabric smoothing, retaining band, with gathering material stitched through, attached to said soft fabric casing, said smoothing, retaining band providing an enclosed pocket for the securing therein of the ends of hair to be rolled around said soft roller;

a first wing/flap which is an extension of the soft fabric casing surrounding said foam layer; and a second wing/flap which is an extension of the soft fabric casing surrounding said foam layer wherein said first wing/flap and said second wing/flap are attachable to each other.

2. The soft roller as defined in claim 1 wherein said soft fabric casing and band are made of a hydrophobic material.

3. The soft roller as defined in claim 2 wherein said hydrophobic material is satin.

4. A method for rolling hair that protects the ends of said hair comprising the steps of:

isolating a tress of hair to be shaped;

acquiring a soft roller around which to roll said tress of hair, said soft roller further comprising:

a supporting center grid that is substantially cylindrical and having a porous and firm but flexible structure through a plurality of vertical and horizontal supports resulting in a plurality of apertures therebetween;

a foam layer surrounding said supporting center grid;

a soft fabric casing surrounding said foam layer;

a soft fabric retaining, smoothing band, with gathering material stitched through, attached to said soft fabric casing, said retaining, smoothing band providing an enclosed pocket for the securing therein of the ends of hair to be rolled around said soft roller;

a first wing/flap which is an extension of the soft fabric casing surrounding said foam layer; and a second wing/flap which is an extension of the soft fabric casing surrounding said foam layer wherein said first wing/flap and said second wing/flap are attachable to each other;

pulling said tress of hair down through space between said soft roller and said smoothing, retaining band;

sliding said soft roller down said tress of hair to smooth and secure ends of said tress of hair between said smoothing, retaining band and said soft fabric case;

wrapping remaining said tress of hair around said soft roller and said retaining, smoothing band and hair ends that are flanked by band and casing;

moving said first wing/flap over said soft roller to come in contact with said second wing/flap without twisting said first wing/flap or said second wing/flap;

attaching said first wing/flap to said second wing/flap;

letting said tress of hair dry or rest and form; and detaching said first wing/flap from said second wing/flap, releasing said tress of hair from said soft roller.

5. The method as defined in claim 4 wherein said soft fabric casing and band are made of a hydrophobic material.

6. The method as defined in claim 5 wherein said hydrophobic material is satin.

* * * * *